US006688290B2

(12) United States Patent
Zehnal et al.

(10) Patent No.: US 6,688,290 B2
(45) Date of Patent: Feb. 10, 2004

(54) INTEGRATED FUEL DELIVERY AND ELECTRONIC POWERTRAIN CONTROL MODULE AND METHOD OF MANUFACTURE

(75) Inventors: Jim Zehnal, Livonia, MI (US); Lakhi N. Goenka, Ann Arbor, MI (US); Mark D. Miller, Monroe, MI (US); Andrew Z. Glovatsky, Plymouth, MI (US); David J. Steinert, Canton, MI (US); Harvinder Singh, Shelby Township, MI (US); Jeff J. Klas, Brighton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 145 days.

(21) Appl. No.: 10/062,321

(22) Filed: Jan. 31, 2002

(65) Prior Publication Data

US 2003/0140897 A1 Jul. 31, 2003

(51) Int. Cl.[7] ..... F02M 33/04

(52) U.S. Cl. ..... 123/468; 123/184.61; 123/198 E; 123/456

(58) Field of Search ..... 123/195 E, 470, 123/469, 468, 456, 184.61

(56) References Cited

U.S. PATENT DOCUMENTS

| | | | | |
|---|---|---|---|---|
| 4,768,487 | A | * | 9/1988 | Yamamoto et al. ..... 123/470 |
| 4,771,751 | A | * | 9/1988 | Haigh et al. ..... 123/470 |
| 5,003,933 | A | | 4/1991 | Rush, II et al. |
| 5,163,406 | A | | 11/1992 | Daly et al. |
| 5,357,931 | A | | 10/1994 | Semence |
| 5,390,648 | A | | 2/1995 | Yanase |
| 5,477,819 | A | | 12/1995 | Kopec |
| 5,568,794 | A | | 10/1996 | Tabuchi et al. |
| 5,611,313 | A | | 3/1997 | Ashcraft |
| 5,713,323 | A | | 2/1998 | Walsh et al. |
| 5,743,235 | A | * | 4/1998 | Lueder ..... 123/468 |
| 6,053,148 | A | | 4/2000 | Glovatsky et al. |
| 6,098,586 | A | | 8/2000 | Bloomer |
| 6,308,686 | B1 | * | 10/2001 | Mammarella et al. ..... 123/470 |
| 6,408,811 | B1 | * | 6/2002 | Glovatsky et al. ..... 123/184.61 |
| 6,435,153 | B1 | * | 8/2002 | McAliece et al. ..... 123/193.3 |
| 6,494,174 | B1 | * | 12/2002 | Daly ..... 123/143 C |
| 6,502,547 | B2 | * | 1/2003 | Kennedy et al. ..... 123/399 |
| 2001/0045206 | A1 | | 11/2001 | Smith et al. ..... 123/478 |
| 2002/0148454 | A1 | * | 10/2002 | Itoh ..... 123/647 |
| 2002/0162545 | A1 | * | 11/2002 | Weingaertner et al. ..... 123/647 |

FOREIGN PATENT DOCUMENTS

| | | |
|---|---|---|
| EP | 1 201 919 A1 | 5/2002 |
| GB | 2 369 408 A | 5/2002 |
| WO | WO 92/14050 | 8/1992 |

OTHER PUBLICATIONS

Search Report Issued to corresponding British Patent Application No. GB 0300441.3, Jul. 9, 2003, pp. 1–4.

* cited by examiner

*Primary Examiner*—Thomas N. Moulis
(74) *Attorney, Agent, or Firm*—Brinks Hofer Gilson & Lione

(57) ABSTRACT

An integrated control and fuel delivery system having an intake manifold that receives a portion of an airflow and delivers air to an engine and a fuel spacer that receives the air from the intake manifold. The fuel spacer includes a wiring harness. A control module is disposed on the fuel spacer adjacent to the intake manifold of the engine.

24 Claims, 5 Drawing Sheets

102

G.F. NYLON OVER-MOLD MATERIAL
221
ALUMINUM CASTING
CONNECTOR FOR PCM
224
105
FUEL RAILS
223
106
WIRING HARNESS
107
220
108
222
CONNECTORS FOR COILS AND INJECTORS

INTEGRATED FUEL DELIVERY AND ELECTRONIC POWERTRAIN CONTROL MODULE AND METHOD OF MANUFACTURE

BACKGROUND OF THE INVENTION

1. Field of Invention

The present invention relates generally to a fuel delivery system for internal combustion engines. More particularly, the present invention relates to a multi-functional fuel delivery system.

2. Related Art

Internal combustion engines used in automobiles and the like employ sophisticated engine control technologies making use of a variety of sensors and actuators in communication with powertrain control module circuitry. Engine control provided by these systems may provide increased performance, reduced emissions and higher reliability in the operation of the vehicle.

The powertrain control module (PCM) circuitry may be located near the vehicle fire wall to provide a secure mounting of the circuitry away from the high temperature components of engine and allow communication with driver instrumentation in the passenger compartment.

The PCM communicates with a variety of sensors on or close to the engine, for example, sensors for air mass flow, engine temperature, throttle position, engine speed and crankshaft position. The PCM, in receiving these sensor signals, produces actuator signals used to control fuel injectors, ignition coils and the like.

Many of the delivery system assemblies are often rigidly attached to the engine in close proximity to one another and have a number of rigid connections between the various components of the different systems. Therefore, access to one system assembly often requires the difficult disengagement of a number of rigid connections as well as removal of a number of components to gain access to the desired components.

BRIEF SUMMARY OF THE INVENTION

One aspect of the present invention regards an integrated control and fuel delivery system having an intake manifold that receives a portion of an airflow and delivers air to an engine and a fuel spacer that receives the air from the intake manifold. The fuel spacer includes a wiring harness. A control module is disposed on the fuel spacer adjacent to the intake manifold of the engine.

Another aspect of the present invention regards an integrated control and fuel delivery system for a vehicle having an engine and an intake manifold that receives a portion of an airflow. The integrated control and fuel delivery system includes a fuel spacer having a casting, a wiring harness connected to the casting, a fuel rail and a over-mold mated to the casting, the wiring harness and the fuel rail. The fuel spacer is disposed between the intake manifold and the engine. The integrated control and fuel delivery system also includes a PCM disposed on the fuel spacer in an airflow that is received by the intake manifold. The PCM is in communication with the wiring harness.

In another aspect, a method of producing an over-molded fuel spacer by placing a casting, a fuel rail, and a wiring harness into an injection molding tool. The injection molding tool over-molds the casting, the fuel rail and the wiring harness with a glass filled nylon material.

Each aspect of the present invention provides the advantages of reducing the number of parts count and providing weight savings. In addition, by moving the PCM to an "on-engine" location, the cost and complexity of the vehicle wiring harness is reduced.

Additional embodiments and advantages of the present invention will become apparent from the following description and the appended claims when considered with the accompanying drawing.

DETAILED DESCRIPTION OF THE INVENTION

Figure 1A:
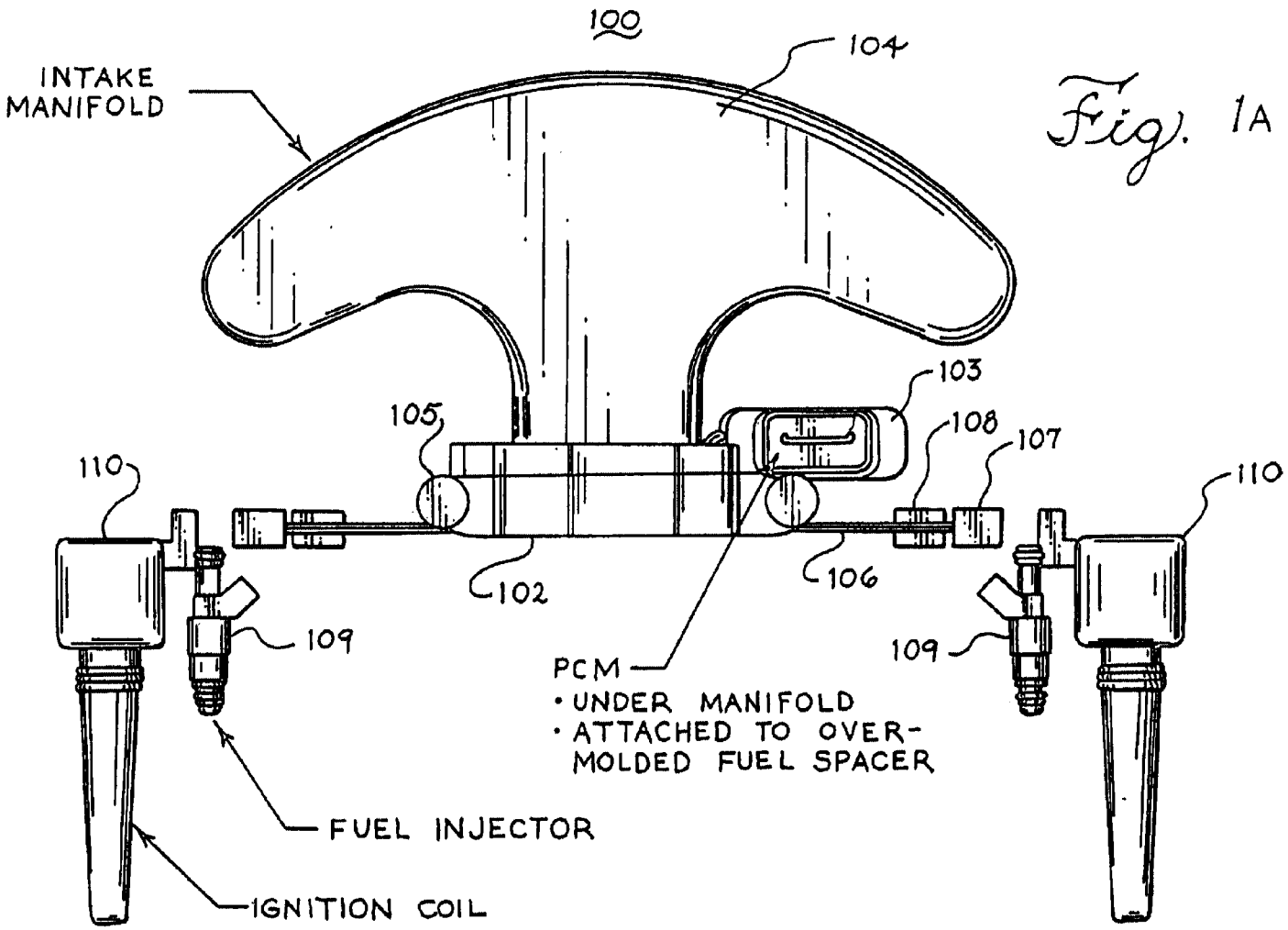
FIG. 1A shows a cross-sectional view of an embodiment of an integrated powertrain control system (IPCS), according to the present invention.
Figure 1B:
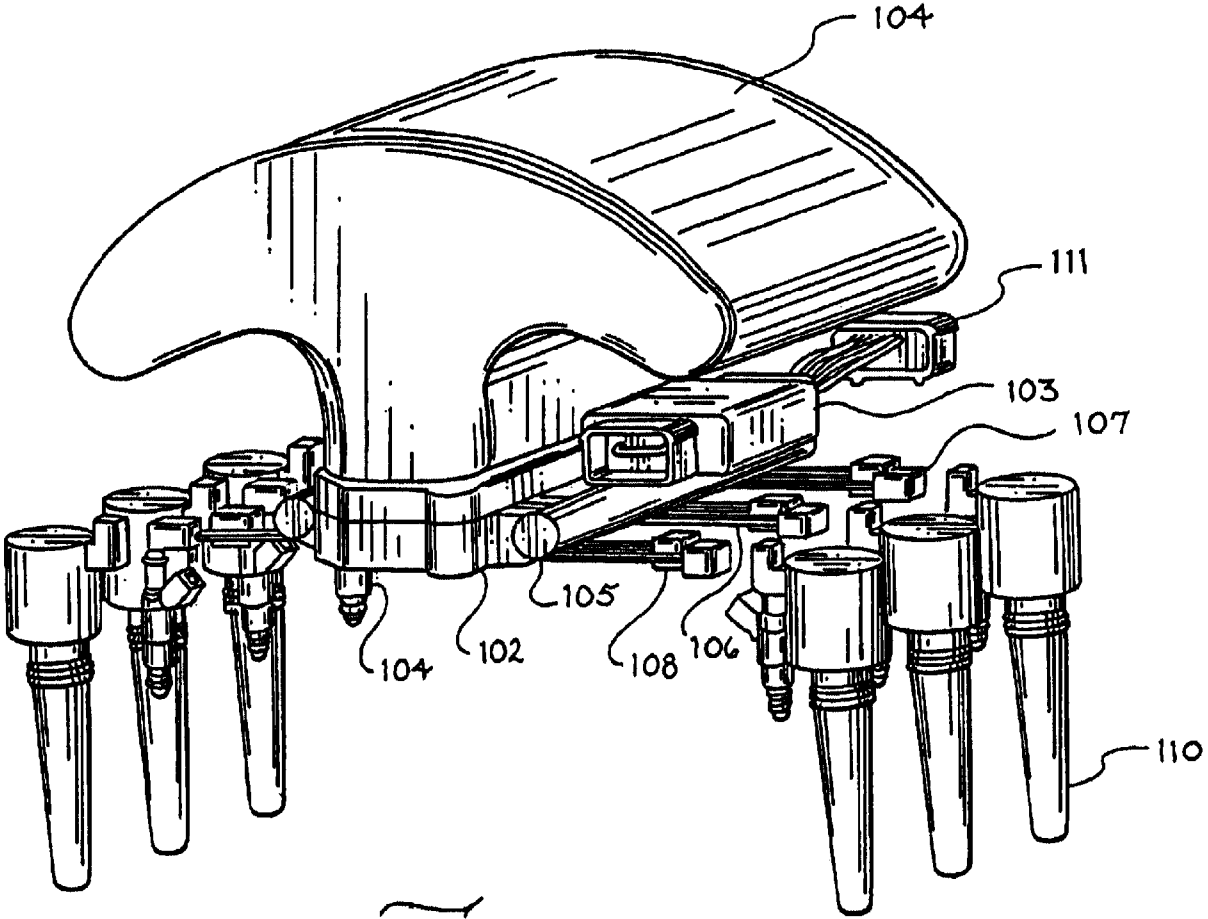
FIG. 1B shows a perspective view of the IPCS of FIG. 1A.
Figure 4:
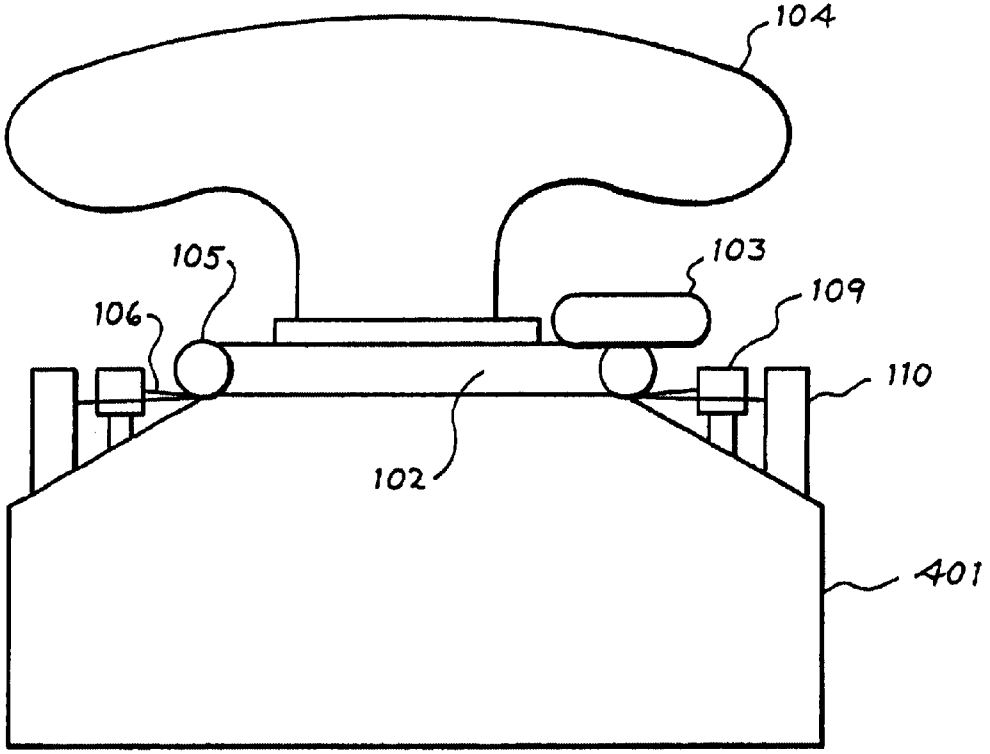
FIG. 4 shows a front view of the IPCS of FIG. 1A disposed between an embodiment of an engine and an intake manifold, according to the present invention.

FIG. 1A shows a cross-sectional view of an embodiment of an integrated powertrain control system ("IPCS") 100. The IPCS 100 includes a fuel spacer 102 and a powertrain control module 103 ("PCM") disposed on the fuel spacer 102. In a preferred embodiment, the fuel spacer 102 is attached to an engine 401 having one or more cylinders, as shown in FIG. 4. The fuel spacer 102 is attached above the cylinders. An upper intake manifold 104 is attached to the top of the fuel spacer 102 such that PCM 103 is adjacent to both the upper intake manifold 104 and an airflow received by the upper intake manifold 104. There are many components near the upper intake manifold 104. Integration into a single system may reduce the part count and simplify final assembly. FIG. 1B shows a perspective view of the IPCS 100 of FIG. 1A. As shown in FIG. 1B, the PCM 103 has a wiring harness connector 111.

Figure 2:
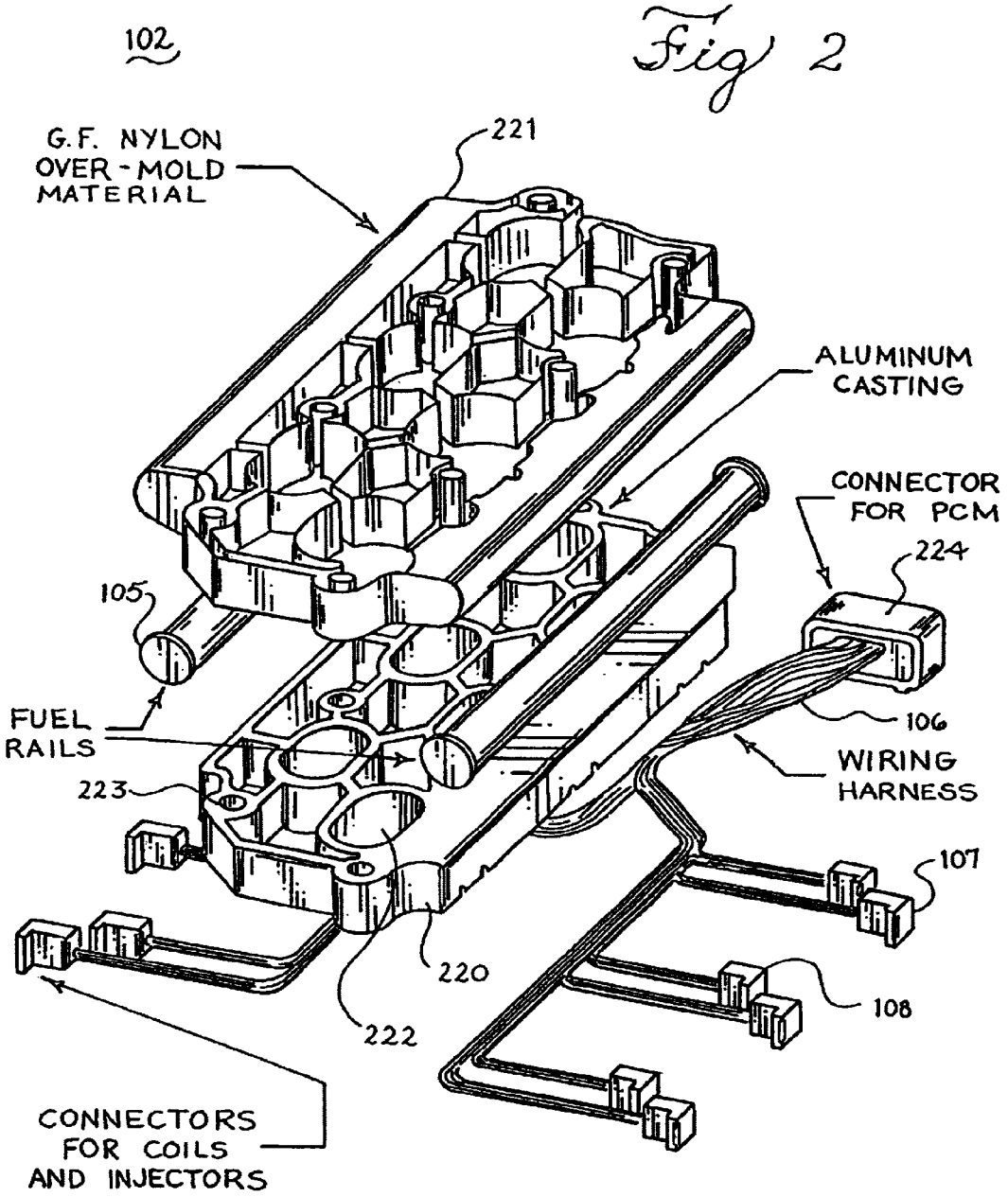
FIG. 2 shows an exploded view of an embodiment of a fuel spacer, according to the present invention.

FIG. 2 shows an exploded view of an embodiment of fuel spacer 102, according to the present invention. The fuel spacer 102 includes a casting 220, a fuel rail 105, a wiring harness 106 connected to the casting 220 and an over-mold 221 mated to the casting 220 and the wiring harness 106.

The casting 220 includes an air-carrier member 222 and bolt-holes 223. The casting 220 is used to facilitate airflow into and out of the engine block via the upper intake manifold 104 (FIG. 1B). The casting 220 is also used to dissipate heat from the PCM 103. Typically, the casting 220 is an aluminum casting, although cast iron or other casting may be used. Aluminum is used because of aluminum's high thermo conductivity. Thus, the aluminum casting 220 may be used as a heat sink.

The wiring harness 106 includes an ignition coil connector 107, a fuel injector connector 108 and a PCM connector 224. In the present invention, the ignition coil connector 107, the fuel injector connector 108 and the PCM connector 224 are integrated connectors and are further described below. The wiring harness 106 may be connected to the underside of the casting 220 by clips or other connectors on the wiring harness 106. In the present invention, the wiring harness 106 is connected to the underside of the casting by the injection mold process described below. The wiring harness 106 may also include other connectors for connecting to various other types of components, such as those attached to a standard wiring harness. The wiring harness 106 electrically connects an ignition coil 110 and a fuel injector 109 to the PCM 103 by connecting the wiring harness connector 111 to the PCM connector 224; however, the wiring harness 106 may be wired directly into the PCM 103 thereby alleviating the need for wiring harness connector 111 and PCM connector 224. FIG. 1B shows the wiring harness 106 electrically connected to six ignition coils 110, to six fuel injectors 109, and to the PCM 103 via the wiring harness connector 111; however, the present invention may be designed to accommodate any number of ignition coils 110 and fuel injectors 109. There is a one-to-one correspondence to the number of fuel injectors 109, ignition coils 110 and the number of cylinders in the engine 401. Typically, the wiring harness 106 is an integrated silicone over-molded wiring harness; however, other types of wiring harnesses may be used, such as an integrate urethane over-molded wiring harness, a standard wiring harness, wiring harnesses later developed. Ignition coil 110, fuel injector 109 and the fuel rail 105 operate in a well known manner.

Figure 3:
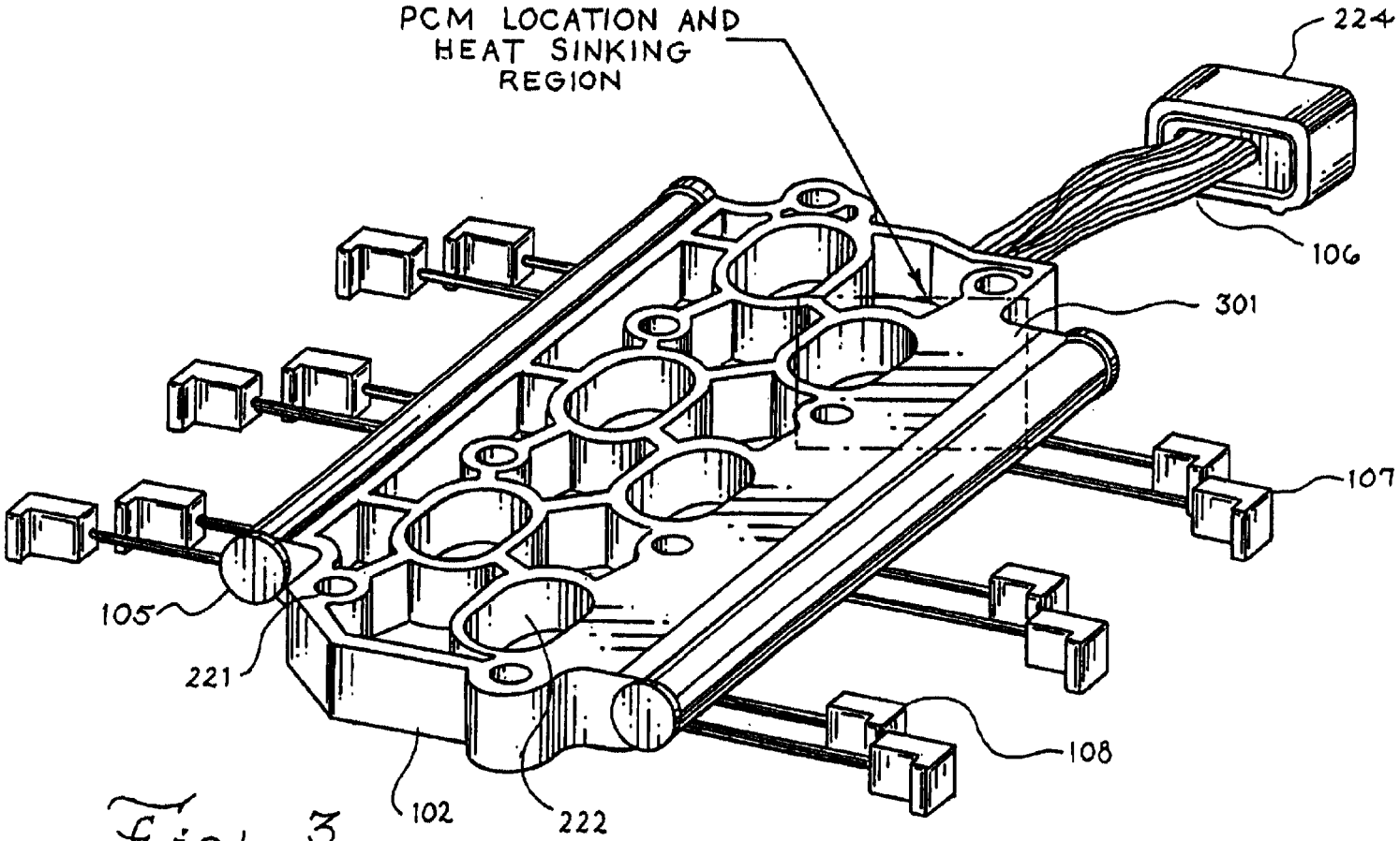
FIG. 3 shows a perspective view of the fuel spacer of FIG. 2.

FIG. 3 shows an embodiment of the final assembly of fuel spacer 102. The fuel spacer 102 is assembled using a molding process. The molding process includes placing the aluminum casting 220, the fuel rail 105 and the silicone over-molded wiring harness 106 into an injection molding tool and over-molding this assembly with the over-mold 221. Two fuel rails 105 are typically placed within the injection molding tool. Typically, the over-mold 221 is made of a glass filled nylon material; however the over-mold 221 may be made of any high temperature polymer or other material.

The fuel injector connector 108, the ignition coil connector 107 and the PCM connector 224 are integrated connectors. Using integrated connectors allows for easy assembly onto the engine block and connection to the appropriate part. Integrated connectors also improve reliability because electrical connections are made to the appropriate parts when the fuel spacer 102 is installed. Other connectors may be used also, such as those attached to a standard wiring harness.

During the molding process, a heat-sinking area 301 is created on an upper portion of the fuel spacer 102 by leaving a section of the aluminum casting 220 uncovered, for attachment of the PCM 103. Final assembly of the IPCS 100 will now be discussed.

Referring to FIGS. 1A, 1B, 3, and 4 the fuel spacer 102 is placed over a cylinder of the engine 401 such that the air-carrier member 222 is arranged in general proximity with a respective cylinder, thus, allowing air to flow through the manifold 104, the fuel spacer 102 into each of the cylinders of the engine 401. The intake manifold 104 is placed on top of the fuel spacer 102. The upper intake manifold 104 and fuel spacer 102 are bolted to the engine by driving bolts through the intake manifold 104, through the bolt-holes 223 and into the engine. Typically, there are two bolt-holes 223 per air carrier member 222. The bolt-holes 223 accept fastener bolts that are used to connect the upper intake manifold 104 and the fuel spacer 102 to the engine 401. Since a gasket may be inserted between the fuel spacer 102 and the engine 401 the fastener bolts provide a proper seal but other bolts may be used.

The PCM 103 is attached to the fuel spacer 103 on the heat sinking area 301. The PCM 103 controls the electrical devices in a vehicle or associated with engine control. The PCM 103 is typically attached by using threaded fasteners. Four fasteners ensure good surface contact between the PCM 103 and the heat-sinking area 301 but fewer or more fasteners may be used. Additionally, a thermally conductive tape may be used between the PCM 103 and the heat-sinking area 301 to further ensure good thermal conductivity. The IPCS 100 may be designed to use either a super integration concept of flexible flatwire substrates, a more conventional style of PCM's using a thick film substrate, such as, FR4 or ceramic, or other now known or better developed substrates.

The PCM 103 may include a circuit board, active or passive integrated circuits, such as a microprocessor or an application specific integrated circuit. The PCM 103 is typically covered by metal or high temperature plastic.

In a preferred embodiment, the PCM 103 is located adjacent to the upper intake manifold 104. The PCM 103 is protected from the high temperatures in the area adjacent to the upper intake manifold 104 because the in-molded aluminum casting 220 acts as a heat sink. Furthermore, by placing the PCM 103 adjacent to the upper intake manifold 104, the PCM 103 is able to use the airflow flowing into the upper intake manifold 104 as the heat-dissipating medium. As stated above, placing the IPCS 100 in this area allows additional sensor/actuator integration, such as integration of electronic throttle body, EGR, fuel pressure sensors, sensors for air mass flow, engine temperature, engine speed and crankshaft position.

The foregoing detailed description is merely illustrative of several physical embodiments of the invention. Physical variations of the invention, not fully described in the specification, may be encompassed within the purview of the claims. Accordingly, any narrower description of the elements in the specification should be used for general guidance, rather than to unduly restrict any broader descriptions of the elements in the following claims.

We claim:

1. An integrated control and fuel delivery system, comprising:

an intake manifold that receives a portion of an airflow and delivers air to an engine; and a fuel spacer that receives said air from said intake manifold;

said fuel spacer comprising a wiring harness;

a control module disposed on said fuel spacer adjacent to said intake manifold of said engine;

wherein said control module is connected to said wiring harness.

2. The integrated control and fuel delivery system of claim 1, wherein said control module comprises a powertrain control module.

3. The integrated control and fuel delivery system of claim 1, wherein said fuel spacer comprises, a casting;

said wiring harness connected to said casting; and an over-mold mated to said casting and said wiring harness.

4. The integrated powertrain control system as claimed in claim 1, wherein said fuel spacer comprises a fuel rail.

5. The integrated control and fuel delivery system of claim 1, wherein said fuel spacer is disposed between said engine and said intake manifold.

6. The integrated control and fuel delivery system of claim 1, wherein said intake manifold is an upper intake manifold.

7. The integrated control and fuel delivery system of claim 3, wherein said over-mold comprises a glass filled nylon over-mold.

8. The integrated control and fuel delivery system of claim 1, wherein said fuel spacer comprises two fuel rails.

9. The integrated control and fuel delivery system of claim 3, wherein said casting comprises an aluminum casting.

10. The integrated control and fuel delivery system of claim 1, wherein said wiring harness comprises a powertrain control module connector, an ignition coil connector, and a fuel injector connector.

11. The integrated control and fuel delivery system of claim 10, wherein said powertrain control module is in electrical communication with said powertrain control module connector, said ignition coil connector and said fuel injector connector.

12. The integrated control and fuel delivery system of claim 1, wherein said wiring harness comprises urethane.

13. The integrated control and fuel delivery system of claim 1, wherein said wiring harness comprises silicone.

14. The integrated control and fuel delivery system of claim 3, wherein said casting comprises an air-carrier member.

15. The integrated control and fuel delivery system of claim 3, comprising a heat-sinking area on an upper surface of said fuel spacer.

16. The integrated control and fuel delivery system of claim 15, wherein said control module is disposed on said heat-sinking area.

17. The integrated control and fuel delivery system of claim 1, wherein said control module is disposed in said airflow.

18. An integrated control and fuel delivery system for a vehicle having an engine and an intake manifold that receives a portion of an airflow, comprising:

a fuel spacer, comprising:

a casting;

a wiring harness connected to said casting;

a fuel rail; and an over-mold mated to said casting, said wiring harness, and said fuel rail;

said fuel spacer disposed between said intake manifold and said engine;

a control module in communication with said wiring harness;

wherein said control module is disposed on said fuel spacer in said airflow.

19. The integrated control and fuel delivery system of claim 18, wherein said control module is a powertrain control module.

20. A method of producing an over-molded fuel spacer, comprising:

placing a casting, a fuel rail and a wiring harness into an injection molding tool;

and over-molding said casting, said fuel rail and said wiring harness with a glass filled nylon material.

21. The method of claim 20 wherein said casting comprises aluminum.

22. The method of claim 20 wherein said wiring harness comprises urethane.

23. The method of claim 20 wherein said wiring harness comprises silicone.

24. The method of claim 20 wherein said wiring harness further comprises a powertrain control module connector, an ignition coil connector, and a fuel injector connector.

* * * * *